United States Patent [19]

Pierce

[11] 4,167,916

[45] Sep. 18, 1979

[54] LIQUID LOADER FOR APPLICATOR PATTERN WHEELS

[75] Inventor: Frank D. Pierce, Carmel, Calif.

[73] Assignee: Lockwood Technical, Inc., Sand City, Calif.

[21] Appl. No.: 916,773

[22] Filed: Jun. 19, 1978

Related U.S. Application Data

[63] Continuation of Ser. No. 726,927, Sep. 27, 1976, abandoned.

[51] Int. Cl.[2] ..... B05C 1/02

[52] U.S. Cl. ..... 118/212; 118/258

[58] Field of Search ..... 427/288, 428; 118/212, 118/258, 259, 261; 101/169, 157, 363; 222/342, 345

[56] References Cited

U.S. PATENT DOCUMENTS

| | | | |
|---|---|---|---|
| 2,371,223 | 3/1945 | Crafts | 101/157 |
| 2,531,036 | 11/1950 | Goettsch | 118/212 |
| 2,787,244 | 4/1957 | Hickin | 118/259 |
| 2,855,895 | 10/1958 | Burns et al. | 118/259 X |
| 2,862,471 | 12/1958 | Sidebotham, Sr. et al. | 118/259 |
| 2,911,942 | 11/1959 | Gross | 118/259 X |
| 2,952,239 | 9/1960 | Stover | 118/216 X |
| 3,366,091 | 1/1968 | Mull | 118/259 |

*Primary Examiner*—John P. McIntosh

*Attorney, Agent, or Firm*—Charlton M. Lewis

[57] ABSTRACT

Obstructive formations are mounted within the liquid containing chamber closely adjacent the working surface of an applicator wheel and opposite the path of one or more of the pattern-forming wheels recesss. Escape of air or recirculated liquid from the recesses and its replacement by fresh liquid is thereby facilitated, improving the effectiveness of wheel operation, especially at high peripheral speeds.

11 Claims, 8 Drawing Figures

FIG. 3.
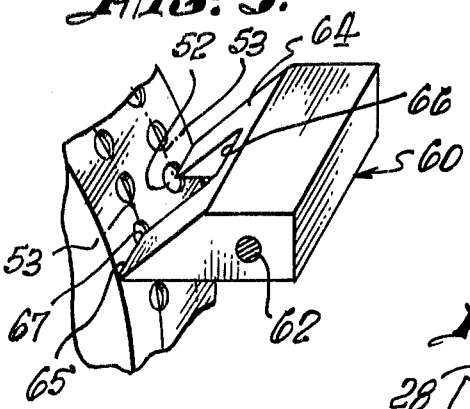
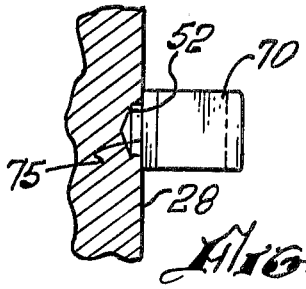
FIG. 5.
FIG. 4.
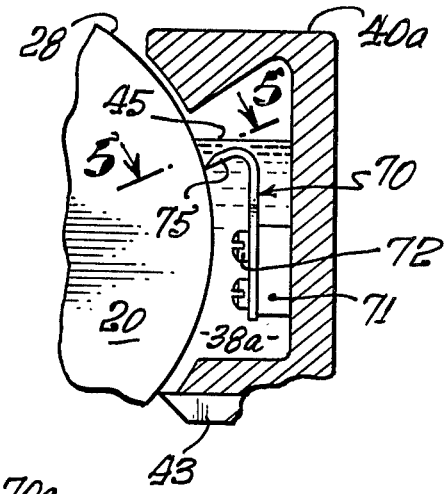
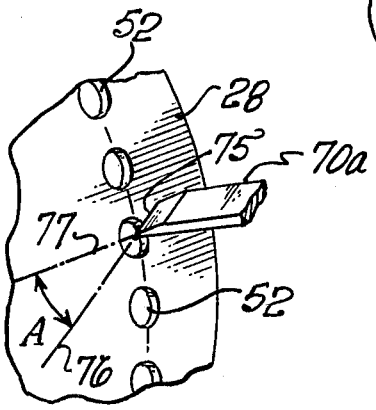
FIG. 6.
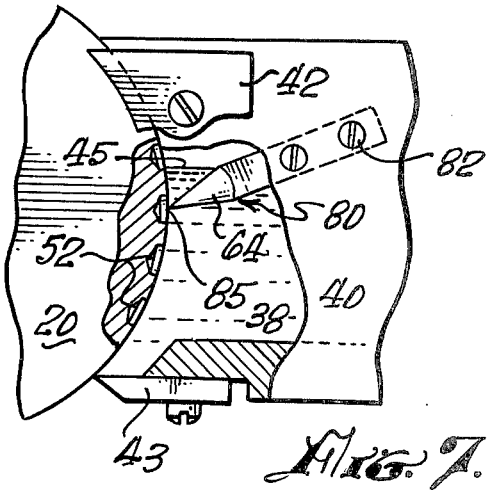
FIG. 7.
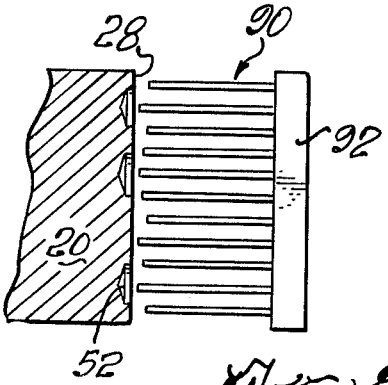
FIG. 8.

LIQUID LOADER FOR APPLICATOR PATTERN WHEELS

BACKGROUND OF THE INVENTION

This application is a continuation of my copending application, Ser. No. 726,927, filed Sept. 27, 1976, now abandoned.

This invention concerns apparatus for applying viscous liquid to a work surface from a rotating applicator wheel which is so mounted that its periphery is partly immersed in a body of the liquid and makes rolling contact with the work surface. As the wheel periphery leaves the wheel chamber in which the liquid pool is contained, a doctor blade or equivalent structure typically meters the liquid carried to the work surface.

The present invention relates especially to such wheel applicators in which the wheel working surface is interrupted by one or more recesses that become filled with liquid from the pool and deposit that liquid on the work surface in a predetermined pattern. Such pattern wheels have the advantage of economizing liquid, since the doctor blade typically wipes clean the wheel surface between recesses so that the amount of liquid applied to the work depends directly upon the size and shape of the recesses. Moreover, in apparatus for applying hot melt adhesive, for example, the strength of the resulting bond can be controlled accurately and conveniently by selection of the size and arrangement of the applied dots or other elements of the pattern.

Such pattern wheels have the potential disadvantage that they have a maximum speed of operation above which the recesses may fail to become fully loaded with liquid during their passage through the liquid pool. That limiting speed depends in a complex manner upon such factors as the detailed form and arrangement of the recesses, the viscosity of the liquid, and the nature of the work surface to which the liquid is applied. One factor limiting the effective wheel speed is the tendency for an air film to be drawn along with the peripheral wheel surface as the latter enters the liquid pool, forming an air boundary layer between the wheel and the body of the liquid. With increasing wheel speed that air barrier is believed to extend further below the free surface of the liquid, until it prevents a full loading of the recesses within the brief time before they leave the liquid pool at the doctor blade. For liquids having the physical properties of conventional hot melt adhesive, for example, and for recesses of the size and shape conventionally used in pattern wheels for applying such adhesive, the maximum peripheral wheel speed for satisfactory operation is typically in the range of 200 to 300 feet per minute for some patterns. For other patterns, including a single row of recesses in an axial plane, for example, the practicable speed may be considerably less.

A further difficulty is sometimes encountered when liquid is applied to a work surface comprising sections that are spaced from each other so that between sections the wheel completes several revolutions without any liquid transfer. One or two rotations may then be required on each new section before the wheel reliably delivers a complete adhesive pattern. The nature of the loading process is apparently so altered during the idle period that the recesses no longer become fully charged.

That behavior is especially marked for wheel applicators designed to overfill each recess, forming a convex liquid bead or meniscus which projects above the working surface of the wheel. The increased thickness of the resulting individual deposits on the work tends to give improved adhesion. Such upstanding beads of deposit can be produced, for example, by maintaining a superatmospheric pressure in the liquid pool immediately behind the doctor blade. As each recess passes under the sharp edge of the doctor blade, such pressure causes liquid to flow around the blade edge, overfilling the recess as it emerges from the blade. As described in U.S. Pat. No. 3,568,636, which issued to Glynn H. Lockwood in 1971 and is assigned to the same assignee as the present application, a desired degree of recess overfilling can be obtained under a wide range of conditions by suitable control of the pressure in the wheel chamber. However, such overfilling may become less effective, or disappear altogether, during interruptions in the work surface. Such incomplete loading tends to be especially serious when the wheel is operated at relatively high linear speed. Thus, the described action may limit the practicable wheel speed when overfilling is relied upon to produce a desired pattern.

SUMMARY OF THE INVENTION

The present invention facilitates the loading of pattern wheel recesses, permitting such wheels to operate satisfactorily over a wider range of operating conditions than has been possible under conventional practice. In particular, the invention typically permits such wheels to operate more effectively at speeds above the conventional limit for any given working conditions, and to operate more reliably on work surfaces that are discontinuous.

In accordance with one view of the invention, such improvements in recess loading are accomplished by producing irregular tumbling movement of the liquid in the immediate vicinity of the recess mouths, or at the mouths of selected recesses.

More particularly, the invention improves recess loading by introducing into the liquid chamber closely adjacent the recess mouths one or more obstructive formations that move relative to the liquid at that region. For example, a continuously driven toothed wheel or equivalent structure may be mounted in such position that its teeth move past the mouths of the applicator wheel recesses, preferably immediately before or after the latter enter the liquid pool. Such tooth movement relative to the liquid is believed to cause roughening of the liquid in the recess mouths, thus defeating the air boundary layer that prevents replacement of liquid into the recesses.

In preferred form of the invention, an obstructive element is mounted in substantially stationary position with at least an active portion extending into the liquid that is carried along by the recesses or by the wheel periphery. Within the pool, viscous drag causes the liquid to move with the wheel surface at a velocity that typically varies from the full wheel speed at the surface to a small fraction of that value at a few tenths of an inch from that surface. If an obstruction of suitable shape is fixedly mounted within that zone of appreciable shear movement, the relative velocity of the obstruction with respect to the moving liquid is believed to disturb the normal flow pattern, causing irregular swirling of the liquid. The resulting roughness or turbulence appears to interfere with the air barrier layer that might otherwise block the liquid from reaching the recess mouths.

The described function of aiding recess loading is performed most effectively by an obstruction that terminates close to the wheel periphery in a configuration having a dimension that is small relative to the width dimension of the recess mouth. The obstruction may end in a sharp point, for example, or in a transverse edge generally parallel to the wheel surface. Particularly effective action is produced by such an edge which is closely spaced from the wheel surface and spans only a portion of the recess mouth. Alternatively, such an edge may be held in light contact with the wheel surface, as by a resilient support; and may span the entire recess opening. In either case, it is often helpful to mount the edge at an oblique angle to the direction of recess movement.

Many of the described advantages of the invention are obtainable by mounting the obstruction just above the free liquid surface, rather than within the liquid pool itself. The working end or edge of the obstruction then preferably makes virtual or actual contact with the wheel periphery at such axial position that at least a portion of a recess passes directly under it. The resulting disturbance of liquid remaining in the recess mouth appears to persist till the mouth enters the liquid pool, then interacting with that liquid to prevent an air boundary layer from becoming established. In any case, such an obstruction has been found effective, especially for dealing with irregular loading due to interruptions of the work surface.

DESCRIPTION OF THE DRAWINGS

The invention is illustrated by way of example in the accompanying drawings, in which

FIG. 3 is a schematic fragmentary perspective corresponding to a portion of FIGS. 1 and 2 at enlarged scale;

FIG. 4 is a fragmentary section corresponding to a portion of FIG. 2 and representing a modification;

FIG. 5 is a fragmentary section on line 5—5 of FIG. 4;

FIG. 6 is a schematic perspective representing a further illustrative modification;

FIG. 7 is a section generally similar to FIG. 4, and representing a modification; and FIG. 8 is a section in the general aspect of FIG. 5 and representing a further modification.

DESCRIPTION OF PREFERRED EMBODIMENTS

Figure 1:
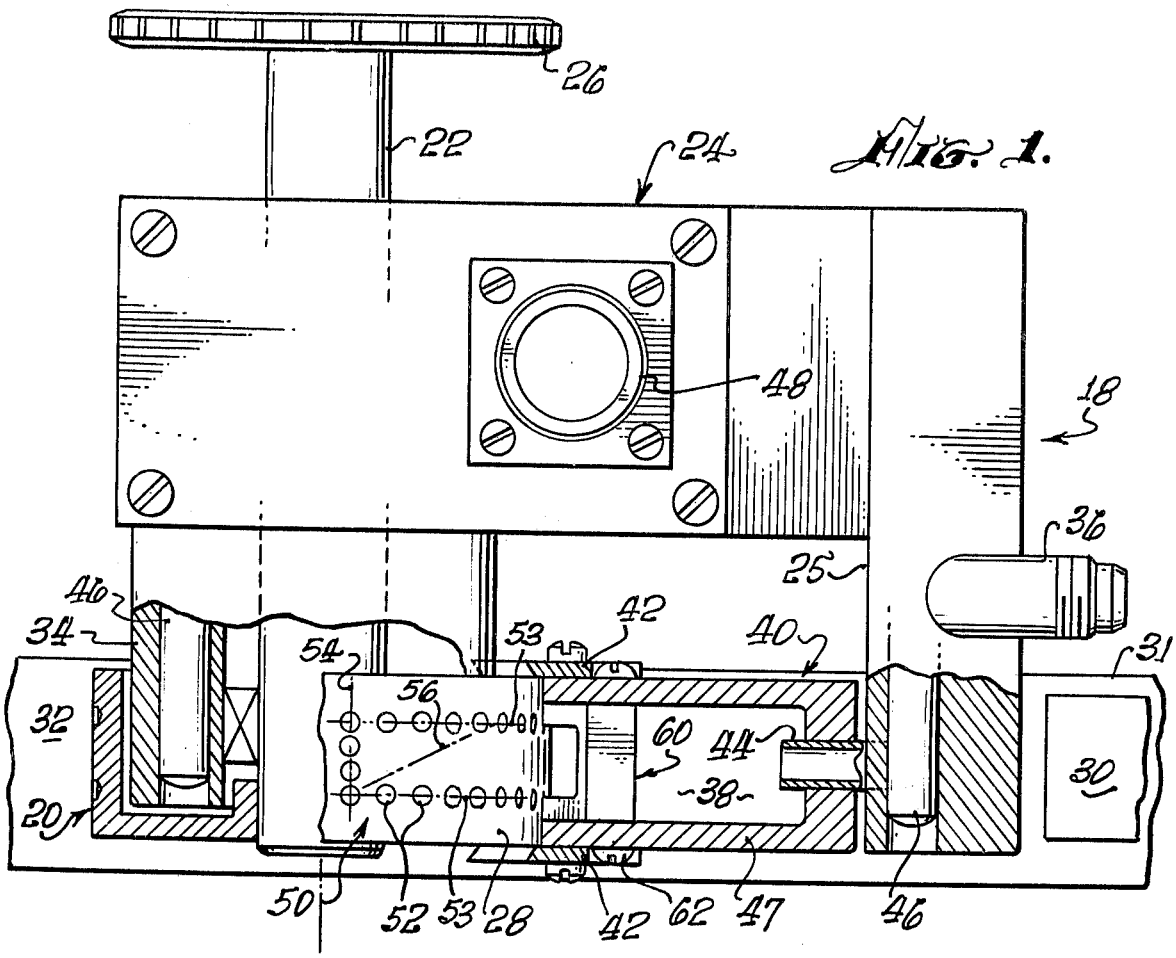
FIG. 1 is a plan, partially cut away, representing an illustrative pattern wheel applicator embodying the invention.
Figure 2:
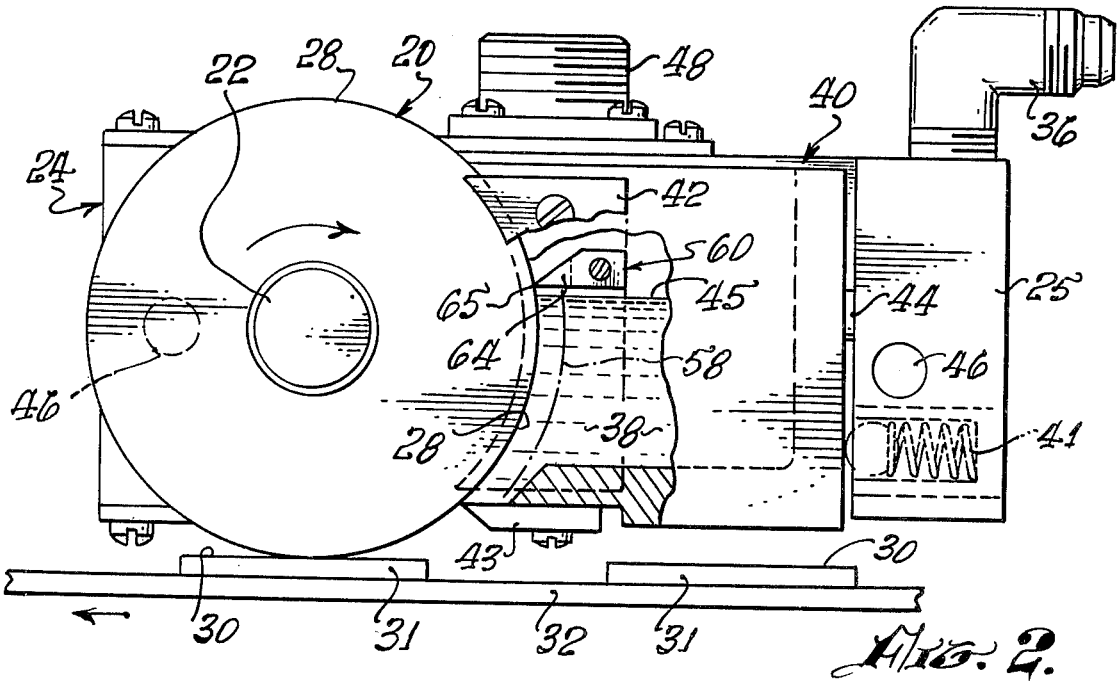
FIG. 2 is an elevation, partly cut away, corresponding to FIG. 1.

The present invention may be successfully embodied in virtually any liquid applicator that employs a patterned wheel. The illustrative applicator shown in FIGS. 1 to 3 comprises the shaft 22, which is journaled on the housing 24 and carries the driving sprocket wheel 26 on one end and the applicator wheel 20 on the other end. The cylindrical peripheral working surface 28 of the wheel typically makes rolling contact with the work surface 30 as successive work pieces 31 are carried past the applicator on the conveyer indicated at 32. The liquid to be applied to work surface 30 is supplied to wheel 20 from the liquid pool 38, which contacts with the wheel periphery and is contained by pot structure of any suitable type. As illustrated, the pot 40 is flexibly mounted on the side arm 25 of housing 24 with an open side of the pot enclosing a portion of the wheel periphery. The pot is pressed yieldingly against the wheel by spring means 41, and a sliding seal between pot and wheel is formed by the wings 42 and the conventional doctor blade 43. The liquid enters pot 40 from housing arm 25 through conduit means 44, with sealing means sufficiently flexible to accomodate any lack of alignment or concentricity. The liquid flow to pot 40 is controlled in any suitable manner, as by a level sensor and servo mechanism, not explicitly shown, to maintain the surface 45 of liquid pool 38 at a substantially constant level. Illustrative pot structures and liquid control mechanisms suitable for use with the invention are described more fully, for example, in U.S. Pat. Nos. 3,352,279 and 3,568,636, which are assigned to the same assignee as the present application.

If the liquid to be applied is solid at normal temperatures, as is true of hot melt adhesives, for example, it is typically melted in a conventional melt-down tank, pressurized by a suitable pump, and supplied via a heated flexible conduit, none of which are explicitly shown, to the conduit fitting 36 on housing arm 25. Liquid pool 38 and applicator wheel 20 are then maintained at a suitable working temperature for the particular adhesive, as by the electrically powered heating elements 46, mounted in respective bores in housing arm 25 and in the housing heater ring 34, which projects with slight clearance into the hollow interior of wheel 20. Those heaters are typically controlled by suitable thermostats, not explicitly shown, with power and control circuits connected via the conventional electrical connector 48.

Wheel working surface 28 is indented by a typical pattern 50 of recesses 52. Conventional recess patterns include a wide variety of configurations, which may comprise from a few to several dozen individual recesses and which may be repeated several times within the wheel circumference. The illustrative pattern 50 comprises the two circumferential lines 53 and the axial line 54 of mutually spaced recesses. The individual recesses may have any desired form, each typically comprising a bore with a diameter approximating 90 mils and a sidewall depth approximating 5 mils. The recess bottom is ordinarily conical with an included angle of the order of 118°. Those figures, however, may vary widely with such factors as liquid viscosity and type of work surface.

In accordance with the present invention, one or more obstructive structures are mounted within pot 40 in position to produce tumbling movement of liquid adjacent the path of at least one of the circumferential lines 53 of wheel recesses. As typically shown in FIGS. 1 to 3, the support 60 bridges the space between the chamber side walls 47, on which it is rigidly mounted by the screws 62. The two obstructive formations 64 project from support 60 toward the periphery of wheel 20 in a generally radial direction, terminating in the respective horizontal working edges 65. Those edges extend inward from the respective pot sidewalls to sharp points at 67 formed by intersection with the sides of cutout 66. The dimensions are typically selected to make edges 65 extend part way across the respective circumferential rows of recesses 53. Support 60 and formations 64 typically comprise integral portions of a solid rod of irregular prismatic shape, two of the prism faces intersecting at an acute angle to form the aligned working edges 65. Screw adjustments of any suitable design may be provided for shifting support 60 relative to the pot to obtain any desired spatial relation of edges 65 to the wheel surface. However, it is usually sufficiently accurate, and is considerably more economical and convenient, to rely upon suitable dimensioning of the parts.

When support 60 is mounted with working edges 65 just above liquid surface 45 in the wheel chamber, as illustratively shown, edges 65 are preferably mounted virtually or actually in contact with the wheel surface. For example, support 60 may be mounted in such position that edges 65 initially positively engage the working face 28 of the wheel. The edges are then quickly ground by the harder wheel surface to a free-running fit. When the working edges are mounted below the liquid surface, a small spacing from the wheel surface is sometimes helpful. However, the working portions of the obstructive formations are in any case preferably close enough to the wheel surface to be well within the zone of liquid which is carried along by shear forces at an appreciable fraction of the linear velocity of the wheel. That zone is indicated schematically at 58 in FIG. 2. Under that condition the normally laminar flow of the liquid is distrubed as it passes the working edges 65. The relative motion of liquid past an edge 65, and especially past its sharp termination, is believed to produce tumbling of the liquid at the wheel surface, defeating formation of any air boundary layer and facilitating the escape of air from nearby recesses and its replacement by liquid.

A single such flow-obstructing formation has been found to insure proper loading of an entire circumferential line of recesses. Also, if a line of recesses is oblique with respect to the circumferential direction, as indicated by the dashed line 56 in FIG. 1, for example, a single obstruction positioned opposite the recess at the leading end of that line will ordinarily cause satisfactory loading of the entire line. If one recess of such a line is loaded by turbulence produced directly by a fixed edge, or its equivalent, the loading process itself apparently causes sufficiently wide disturbance of the liquid flow to insure loading of successive recesses along the line. Similarly, an obstruction positioned opposite the recesses of a circumferential line ordinarily produces effective loading of an intersecting transverse line of recesses such as 54 or 56, so that individual points do not need to be provided for each recess of such a transverse line. However, additional loading structures may be mounted opposite some or all of such recesses if desired.

FIG. 4 illustrates a modified structure which is especially convenient for mounting in a pot 40*a* which forms a liquid pool 38*a* of limited dimension radially of the wheel. The obstructive element 70 of FIG. 4 typically comprises a strip of thin resilient shim stock rigidly mounted at one end, as by the screws 72 and the spacer 71, and having its working end bent to an L form and ground to a sharp transverse edge 75. Element 70 is typically so dimensioned that edge 75 is yieldingly pressed with light force against the wheel surface 28. Edge 75 is shown illustratively in FIG. 5 spanning the full diameter of the recess mouth, but may be dimensioned alternatively with one end terminating within the mouth width.

FIG. 6 represents in schematic perspective the further feature whereby an element 70*a* of blade form is mounted at an oblique angle A with respect to the axial direction 77 of the wheel. Such oblique positioning of an obstructive element may be utilized with substantially any configuration, though having little significance for a conical form such as that of FIG. 7, described below. The shank orientation may also be varied widely either for modifying the action upon the liquid or for convenience in mounting.

FIG. 7 illustrates a modified obstructive member comprising a rigid rod-like support 80 mounted on one sidewall of the wheel chamber by the screws 82 and directed generally radially toward the wheel. The inner end of the rod is shaped to form an obstruction of the desired configuration. As illustrated, the rod is conically tapered to a point at 85, which preferably directly opposes the recesses 52 upon which it is intended to act. The rod end may also be formed to a blade-like formation, generally similar to the blade edges of the previously described embodiments. It will be noted that the structures of FIGS. 3, 4, 6 and 7 have in common the property that the obstructive formation tapers substantially to a point in a plane perpendicular to the wheel axis 21, such as the plane of the paper in FIGS. 4 and 7.

FIG. 8 is typical of the wide variety of detailed structures that may be used effectively in the present invention. As illustratively shown, a plurality of resilient wires 90, typically having a diameter of only a few mils, have one end mounted in any convenient manner in the support 92 and extend in spaced parallel relation to form a comb structure. Alternatively, a large number of such elements may be grouped randomly, forming a relatively thick brush structure. The free ends of wires 90 may lightly touch the wheel surface 28, or may be slightly spaced from that surface, as shown. That spacing may be varied so that the wires produce a variety of disturbance patterns in the shear flow of the liquid. Such an array is particularly effective for aiding the loading of a wheel pattern that includes widely or nonuniformly spaced recesses which must be treated individually.

I claim:

1. In combination with a liquid applicator which includes a rotatable pattern wheel having a recessed peripheral surface that moves through a body of liquid contained in a wheel chamber and into rolling contact with a work surface to apply a predetermined pattern of discrete liquid deposits thereon, said wheel surface having a plurality of recesses with recess mouths mutually spaced peripherally of the wheel in accordance with said pattern, said body of liquid having a free liquid surface such that at elevated wheel speeds at least one recess tends to be incompletely loaded with the liquid; the improvement comprising means for producing irregular tumbling of the liquid at the path of movement of the mouth of said one recess to assist loading of the recess, said means comprising structure mounted in the chamber and projecting in a generally radial direction toward the wheel surface and terminating closely adjacent the wheel surface in a working edge of limited length which directly faces the wheel surface with the length of the edge generally transverse of the direction of movement of the wheel surface, said working edge being so positioned laterally of the path of movement of the mouth of said one recess that the length of the edge spans only a portion of the width of that path.

2. Combination according to claim 1 wherein at least one end of said working edge forms an angular corner closely adjacent the wheel periphery and within the width of the path of movement of said one recess mouth.

3. Combination according to claim 1 or 2 wherein
said liquid body includes a layer adjacent the wheel surface that is moved by shear forces at an appreciable fraction of the wheel surface velocity,
and said working edge is positioned within said liquid layer.

4. Combination according to claim 1 or 2 wherein said working edge is positioned immediately above said free surface of the liquid body.

5. Combination according to claim 1 or 2 wherein said working edge has a length less than the width of said recess mouth.

6. Combination according to claim 1 or 2 wherein the length of said working edge is obliquely transverse of the direction of movement of said wheel surface.

7. Combination according to claim 1 or 2 wherein said structure includes resilient means for supporting said working edge in yielding engagement with said wheel surface.

8. In combination with a liquid applicator which includes a rotatable pattern wheel having a recessed peripheral surface that moves through a body of liquid contained in a wheel chamber and into rolling contact with a work surface to apply a predetermined pattern of discrete liquid deposits thereon, said wheel surface having a plurality of recesses with recess mouths mutually spaced peripherally of the wheel in accordance with said pattern, said body of liquid having a free liquid surface and a relatively high viscosity of such value that at elevated wheel speeds at leat one recess tends to be incompletely loaded with the liquid;
the improvement comprising
means for producing irregular tumbling of the liquid at the path of movement of the mouth of said one recess to assist loading of the recess, said means comprising
support means mounted in the chamber,
and structure extending from the support means generally radially toward the wheel surface and terminating in a working formation which is closely adjacent the wheel surface at only a selected portion of the width of said path of movement of the mouth of said one recess,
whereby the normal movement of the liquid with the wheel surface by viscous drag is obstructed sharply differently at different portions of the width of said path.

9. Combination according to claim 8 wherein said structure tapers toward the wheel surface and terminates substantially in a point directed toward that surface.

10. Combination according to claim 9 wherein said tapering structure is inclined obliquely toward said wheel surface.

11. In combination with a liquid applicator which includes a rotatable pattern wheel having a recessed peripheral surface that moves through a body of liquid contained in a wheel chamber and into rolling contact with a work surface to apply a predetermined pattern of discrete liquid deposits thereon, said wheel surface having a plurality of recesses with recess mouths mutually spaced peripherally of the wheel in accordance with said pattern, said body of liquid having a free liquid surface such that at elevated wheel speeds at least one recess tends to be incompletely loaded with the liquid; the improvement comprising
support means mounted in the chamber,
structure extending from the support means generally radially toward the wheel surface and tapering substantially to a point which is directed toward that surface and terminates closely adjacent the path of movement of the mouth of said one recess through the liquid.

* * * * *